United States Patent [19]

William et al.

[11] 4,096,300

[45] Jun. 20, 1978

[54] PROCESS OF COATING A SERIES OF METAL MEMBERS

[76] Inventors: Virgil R. William, 2055 Webb Gin House Rd., Snellville, Ga. 30278; James M. Williams, Jr., 2996 Payton Rd., Atlanta, Ga. 30329

[21] Appl. No.: 689,587

[22] Filed: May 24, 1976

[51] Int. Cl.[2] ..... B44D 1/46; B05D 1/02; B05D 3/12

[52] U.S. Cl. ..... 427/292; 427/318; 427/327; 427/378; 427/379; 427/424; 118/64; 118/72; 118/314; 118/316; 118/326; 118/500; 118/503

[58] Field of Search ..... 427/424, 379, 378, 318, 427/290, 209, 327, 292; 118/305, 302, 314, 316, 326, 503, 500, 64

[56] References Cited

U.S. PATENT DOCUMENTS

| | | | |
|---|---|---|---|
| 2,279,686 | 4/1942 | Kerlin | 427/424 X |
| 2,299,026 | 10/1942 | Merrill | 427/424 |
| 2,771,056 | 11/1956 | Hess | 118/64 |
| 2,809,129 | 10/1957 | Peterson | 427/327 |
| 3,011,911 | 12/1961 | Movey | 118/326 X |
| 3,103,446 | 9/1963 | Fitzsimmons | 427/379 |
| 3,161,530 | 12/1964 | Stobel | 427/318 X |
| 3,294,573 | 12/1966 | Michael et al. | 427/318 |
| 3,634,122 | 1/1972 | Grefe et al. | 427/424 X |
| 3,639,142 | 2/1972 | Maxwell et al. | 118/503 X |
| 3,689,311 | 9/1972 | Loeffler et al. | 427/292 |
| 3,728,776 | 4/1973 | DeFazio | 427/318 X |

FOREIGN PATENT DOCUMENTS

| | | | |
|---|---|---|---|
| 556,255 | 4/1958 | Canada | 427/424 |

*Primary Examiner*—Ralph S. Kendall
*Attorney, Agent, or Firm*—Jones, Thomas & Askew

[57] ABSTRACT

A portable automated coating plant is formed in sections that are transported individually to various work sites and the sections are assembled in end-to-end relationship for progressively cleaning and coating steel members, or the like. The members are passed in sequence through a shot blast machine a coating system, and a dryer.

6 Claims, 8 Drawing Figures

PROCESS OF COATING A SERIES OF METAL MEMBERS

BACKGROUND OF THE INVENTION

When metal members such as I-beams, pipe hangars, valves, fittings, machinery, sheets, plates, grating, pipe, and miscellaneous other items, fabricated from steel, iron or other hard materials, hereinafter referred to collectively as steel members, are manufactured, the manufacturing site for steel building members is usually a long distance from the site of construction of the machinery, equipment or building in which the steel members are used. The steel members therefore must be transported from the manufacturing facility to the construction site, and the members frequently must be stored prior to being used in the construction of the building. During the transportation and storage of the steel members, the surfaces of the members tend to rust and become otherwise contaminated so that the members are sometimes not suitable for use at the construction site.

While the manufacturers of steel members have developed various techniques for protecting the surfaces of the members, such as the application of paint and other protective coatings, the protective coatings tend to become damaged during handling of the steel members so that the members are not completely protected as desired. In some machinery, equipment or building structures it is highly desirable to receive and to erect the steel members in virtually perfect condition, without the presence of any surface contaminants. To provide the steel members in this condition requires the builder or a subcontractor to manually treat the steel members after delivery thereof at the construction site to remove the contaminants. The on site manual processes usually are difficult and expensive to undertake because of the massive size and weight of the steel members and the processes usually must be performed in a controlled environment such as inside a large building.

SUMMARY OF THE INVENTION

Briefly described, the present invention comprises a portable automated coating plant which is divided into sections so that it can be taken apart and moved in sections across public highways to a construction site or other desired location, assembled, and used in cleaning and coating large steel members and the like. The assembled portable coating plant includes loading and unloading sections, a cleaning section, a coating section, and a drying section. The sections are arranged in end-to-end relationship so that the steel members move progressively through each section, and the internal environment about the steel members is controlled as the steel members are treated.

The cleaning section includes a gas-fired preheater which rapidly increases the temperature of the steel members and a steel abrasive machine which propels finely divided shot or grit from several angles toward the steel members to clean the scale and other surface contaminants from the members. The steel members move directly from the steel abrasive machine to the coating section wherein the opposite sides of the steel members are coated with spray paint or other surface coatings, and the air in the coating section which becomes contaminated with paint is cleaned prior to being exhausted to the atmosphere. The steel members move directly from the coating section to the drying section where they are first contacted with high velocity air for the purpose of drying off excess solvents which are used in the paint for dilution purposes, and the members are subsequently moved into a higher temperature environment for the purpose of baking the paint. Each section of the portable coating plant includes its own surface roller conveyer, and the sections of the conveyor operate in unison so as to progressively move the members to be treated through each of the sections of the plant. Some or all of the sections of the plant can be assembled and used as may be desired.

Thus, it is an object of this invention to provide a portable coating plant which can be erected at a building site or at other locations and can be used to clean and coat steel members and to cure the coating.

Another object of this invention is to provide an automated system for use at a building site or at other locations which functions automatically, inexpensively and expediently to treat steel members.

Other objects, features and advantages of the present invention will become apparent upon reading the following specification, when taken in conjunction with the accompanying drawing.

DETAILED DESCRIPTION

Figure 1:
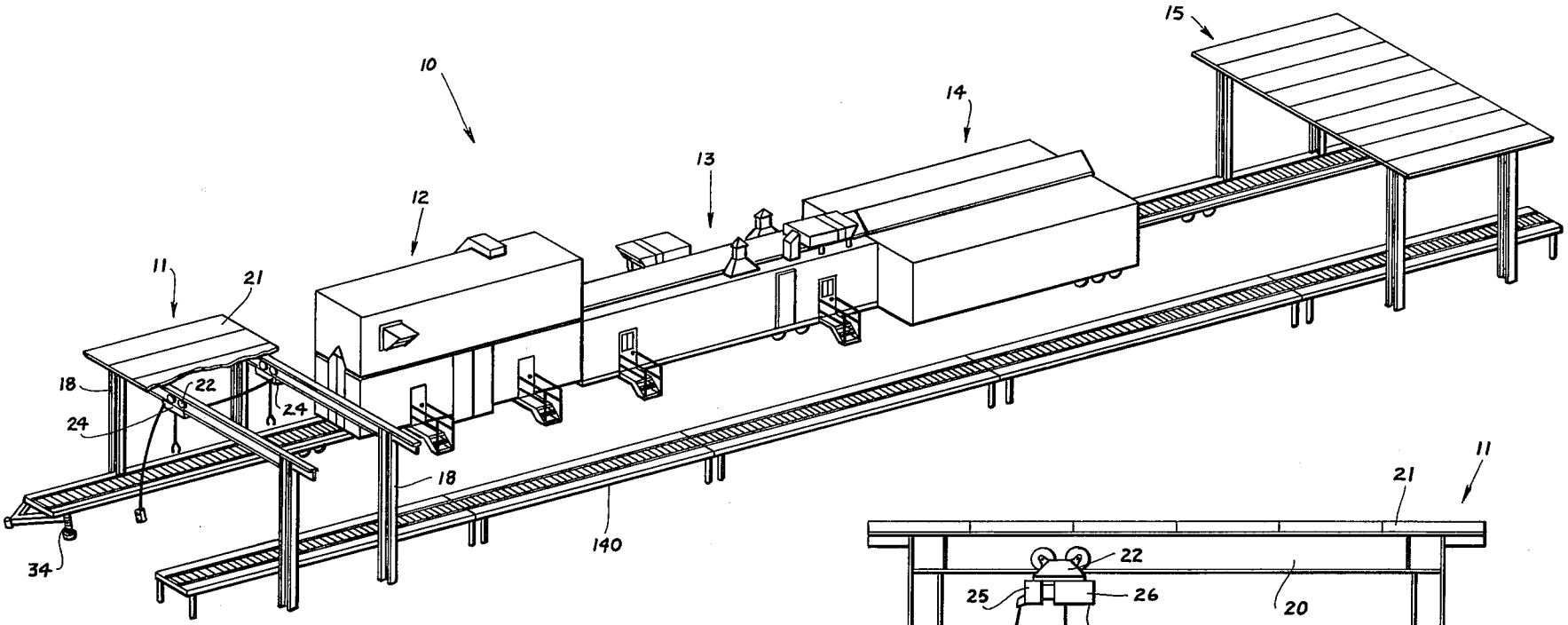
FIG. 1 is a schematic perspective illustration of the portable automated coating plant.

Referring now in more detail to the drawings, in which like numerals indicate like parts throughout the several views, FIG. 1 illustrates the portable automated coating plant 10 which includes a loading section 11, a cleaning section 12, a coating section 13, a drying section 14, and an unloading section 15. Each of the sections 11–15 are portable and they are mounted on wheels for transportation across public highways to a building site, and the sections are then connectable to one another in end-to-end relationship. The sections are required to handle the large and heavy metal members of the type used in the construction of buildings, processing plants and various equipment and machines, hereinafter collectively referred to as steel members. The size and weight of the steel members require the framework for each section to be strong and heavy and the site at which the portable coating plant is to be erected usually will have been prepared by the placement of concrete footings at the anticipated positions of support for the coating plant, and the sections will be mounted on the concrete footings, usually with leveling jacks or other support means.

Figure 2:
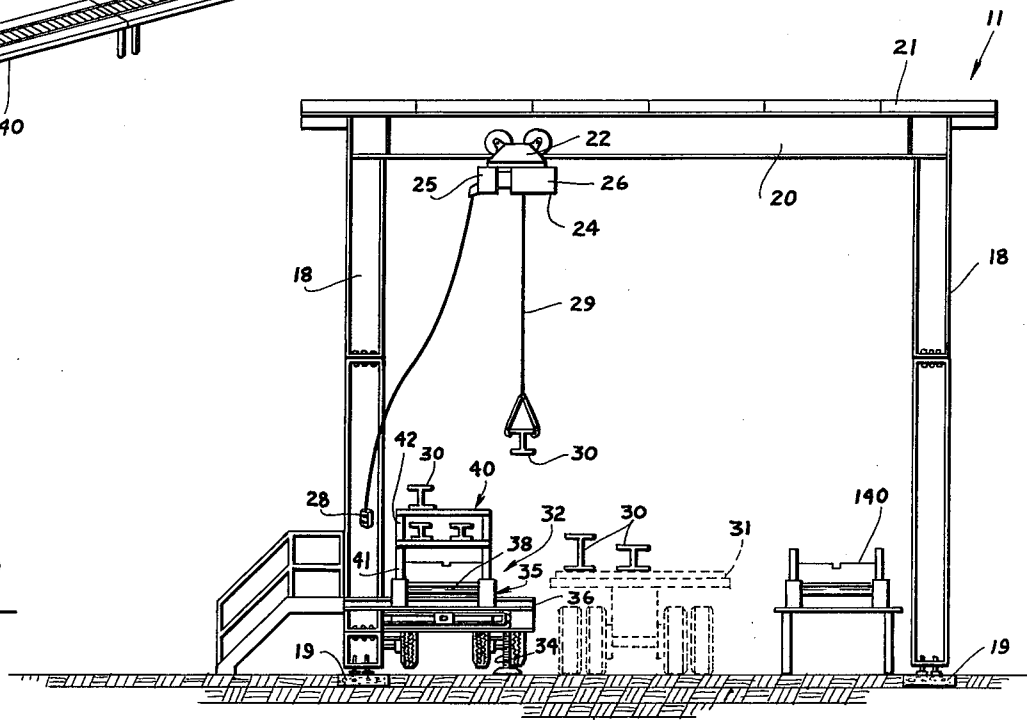
FIG. 2 is an end elevational view of the loading section of the coating plant.
Figure 3:
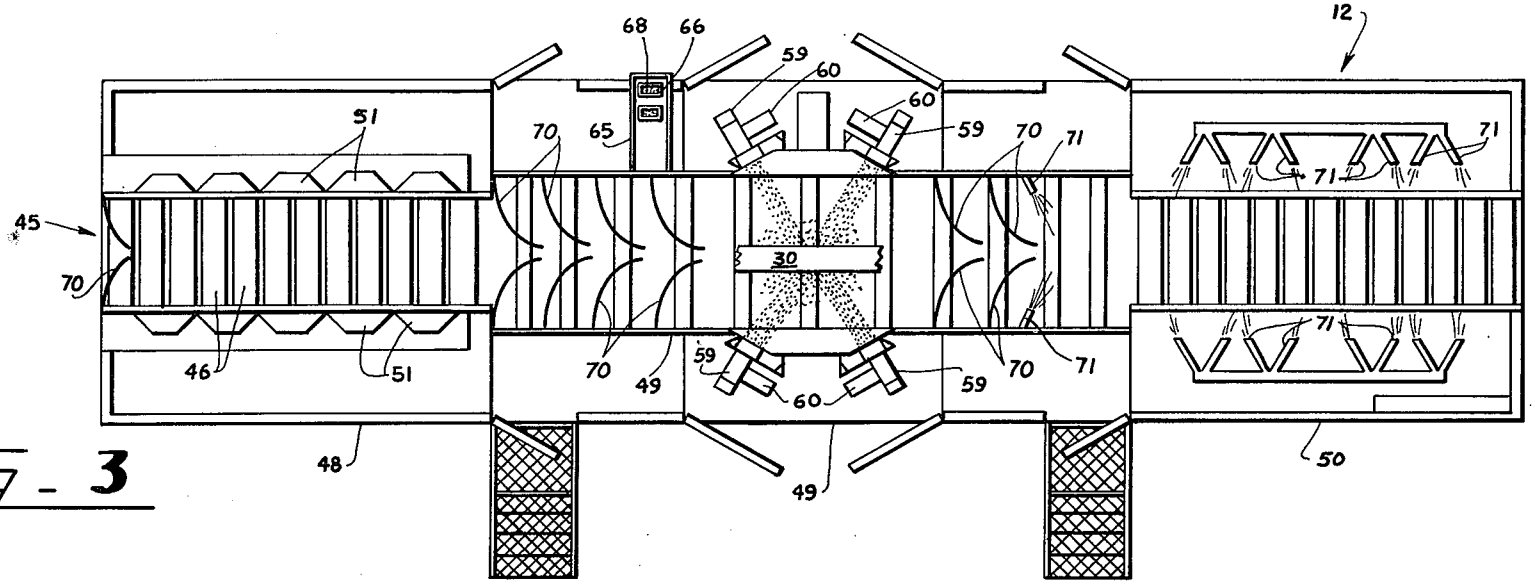
FIG. 3 is a plan view of the lower portion of the cleaning section of the coating plant.

As is illustrated in FIG. 2, the loading section 11 comprises vertical beams 18 mounted on concrete footings 19 and overhead rails 20 which support a roof 21 and trolleys 22. The trolleys 22 each support an electric hoist 24 which includes an electric motor 25 and a winch 26. A control box 28 is suspended from one of a hoist 24 to control the movement of both of the hoists 24 and each of the trolleys 22, and the cable 29 suspended from each winch 26 is therefore operable to load and unload the steel members 30.

The steel members 30 are usually transported to the building site by means of a customer's trailer 31 or other conventional means, and the loading section 11 includes its own portable conveyor and work platform assembly 32 which is supported at the building site with leveling jacks 34. A power driven roller conveyor 35 is mounted on the work platform 36 and includes a plurality of power driven rollers 38 spaced along the length of the platform 36 and which are driven by chains extending about sprockets at the ends of the rollers, or by any other conventional manner (not shown). The conveyor 35 of the loading section 11 is aligned with similar conveyors of the other sections 12–15 and functions to begin the movement of the steel members as they begin to move through the coatings plant.

A sectional work cart 40 is placed on the roller conveyor 35 and includes a lower section 41 and one or more upper sections 42. The steel members 30 which are to be treated by the coating plant are loaded onto the work cart 40, and if the steel members 30 are small enough, one or more additional sections 42 of the work cart can be used to stack several layers of the members 30 in one load of members.

The cleaning section 12 is positioned adjacent loading section 11 and includes its own power-driven roller conveyor system 45 which is in alignment with the conveyor system of the loading section 11 and which includes its own rollers 46 arranged to move the work cart 40 and the steel members 30 on through the plant. The cleaning section 12 includes a preheat zone 48, a steel abrasive machine 49, such as a shot blast or grit blast machine (hereinafter referred to as shot blast machine) and an inspection zone 50. The preheat zone includes a plurality of gas-fired radiant heaters 51 located on opposite sides of the conveyor 45 for the purpose of rapidly heating the surfaces of the steel members to an elevated temperature. The rapid increase in temperature of the steel members causes the steel members to be at a desirable working temperature above the outside ambient temperature as the members are moved into the shot blast machine 49. Also, the preheat zone 48 vaporizes foreign contaminants such as moisture, oil, greases, etc. which would be detrimental to the subsequent coating process. The rapid and intense increase in temperature of the steel members tends to cause millscale to pop off the surfaces of the steel members.

Figure 4:
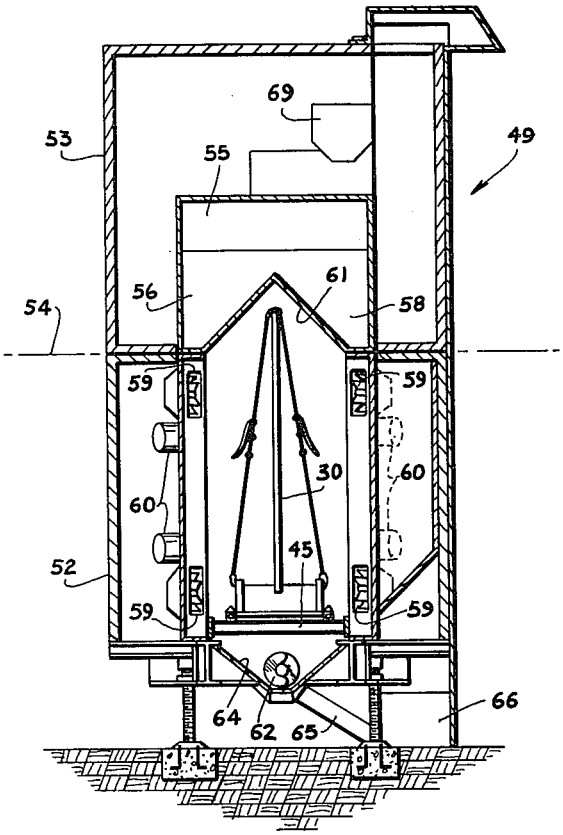
FIG. 4 is a side cross-sectional view of the shot blast machine of the cleaning section of the coating plant.

The shot blast machine 49 is so large that it does not meet the regulations with respect to maximum height for public highways. Thus, as illustrated in FIG. 4, the shot blast machine is formed in lower and upper sections 52 and 53 which are joined together by mating pins and openings (not shown) at the horizontal line of separation 54. The upper section 53 includes a shot hopper 55 that includes downwardly converging hopper feed sections 56 and 58 which converge toward opposite sides of the path of movement of the steel members as they are moved by the conveyor 45. The lower section 52 includes a plurality of rotary blast wheels 59 which are driven by the motors 60, and shot from the shot hopper 55 is fed to each of the rotary blast wheels 59. The rapid rotation of the rotary blast wheels 59 propels the shot toward the path of the steel members 30 being moved to the shot blast machine. The impingement of the shot against the metal surfaces of the members 30 causes the surfaces of the steel members to be thoroughly cleaned of its surface contaminants, including rust and millscale. The shot hopper 55 has its downwardly converging side portions 56 and 58 arranged so as to provide a central upper space or passage 61 for the movement of tall members such as the tall steel member 30 illustrated in FIG. 4.

An auger conveyor 62 is positioned in a trough 64 at the lower portion of the shot blast machine, and the shot propelled against the steel members 30 is allowed to fall down between the rollers of the roller conveyor 45 into the trough and into the vicinity of the auger conveyor 62. The auger conveyor moves the shot to one end of the shot blast machine 49 and to a downwardly inclined chute 65, where the shot moves under the influence of gravity down the chute 65 to an upwardly extending bucket conveyor 66. The buckets 68 of the bucket conveyor retrieve and lift the shot in an upward direction and dump the shot into a separator 69 which screens out the debris from the shot and allows the shot to fall into the shot hopper 55. Thus, a continuous recycling of the shot is achieved by the shot blast machine 49. The bucket conveyor is separated from the lower and upper sections 52 and 53 and transported in a horizontal attitude when the coating plant is being moved between operating sites.

There are eight blast wheels 59 in the shot blast machine 49, with four of the wheels being located in the upper portion of lower section 52 and the other four wheels 59 being located in a lower portion of lower section 52, and the wheels are angled so that the shot is directed upwardly and downwardly and fore and aft so as to cause the shot particles to impinge against the structural members in several directions, to avoid being masked or blocked by the shapes of the steel members or the position of the components of the work cart.

The shot blast machine 49 is separated from the preheat zone 48 and the inspection zone 50 by means of flexible curtains 70. When the steel members emerge through the curtains 70 are received in the inspection station 50, some of the shot particles are likely to remain on the horizontal surfaces of the members, and it is desirable to remove the shot prior to applying a coating to the members. Air jets are directed against the steel members by a series of air nozzles 71 located on opposite sides of the path of movement of the steel members, and the nozzles 71 are connected to a source of air under pressure (not shown). In addition to the air jets, large rotatable brushes (not shown) can be used to engage the members to remove the shot, if desired.

The gas-fired radiant heaters 51 in the preheat zone 48 are controlled by a temperature sensing system (not shown) so that the heaters will increase and decrease their intensity as required by the system. The control of the heaters 51 can be adjusted to raise the temperature of the surface of the steel members up to 500° F. The temperature of the steel members passing through the preheat zone will be determined not only by the intensity of heat emanated from the heaters 51 but also by the velocity at which the steel members are moved through the preheat zone 48. When the steel members pass through the shot blast machine 49, the impingement of the shot against the surfaces of the steel members tends to add additional heat to the members due to frictional contact, and the air jets supplied by the nozzle 71 in the inspection section 50 tend to cool the members. The amount of air flowing against the steel members can be increased beyond that amount required for removal of the shot from the horizontal surfaces of the members so as to increase the cooling of the members, if desired. Thus, the temperature of the steel members can be controlled so that the members are at a desirable temperature for coating as they move beyond the cleaning section 12 into the coating section 13.

Figure 5:
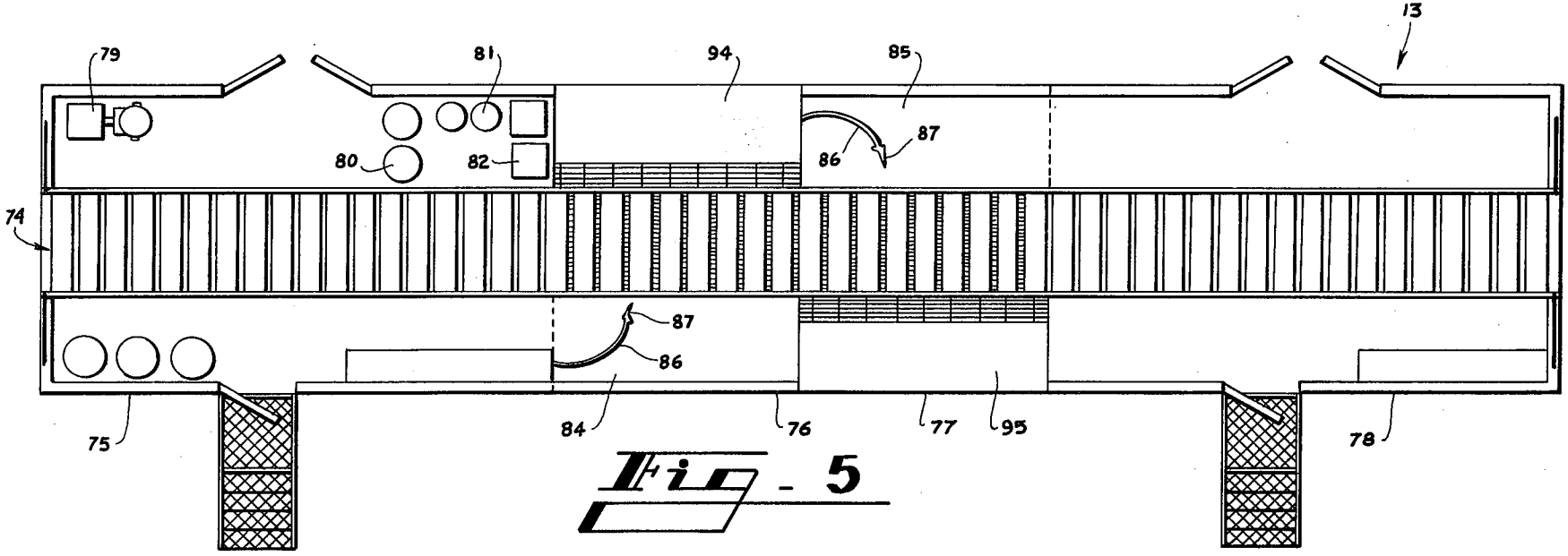
FIG. 5 is a plan view of the coating section of the coating plant.

As illustrated in FIG. 5, the coating section includes its own power driven roller conveyor 74 which is positioned in alignment with the conveyors of the loading section 11 and cleaning section 12, and the coating section 13 includes an inlet inspection 75, a first paint section 76, a second paint section 77, and an outlet inspection section 78. The inspection section 75 and 78 accommodate various paint mixers 79, spray pots 80, airless pump 81, paint heaters 82 and other equipment usable in the coating procedure.

First and second paint sections 76 and 77 are substantially identical to each other except that they are reversed, with first paint section 76 having an operator's station 84 on one side of the conveyor 74 and with the second paint section having its operator's station 85 on the other side of the conveyor 74. Each operator's station 84 and 85 includes a flexible paint spray conduit 86 with a spray nozzle 87 at its end, with the conduit 86 being connected to the pumps in the inspection station 75 or 78. The operators in the operators' stations 84 and 85 manipulate the flexible conduits and nozzles to apply a coating of paint or other substance to the steel members moving through the coating section 13.

Figure 6:
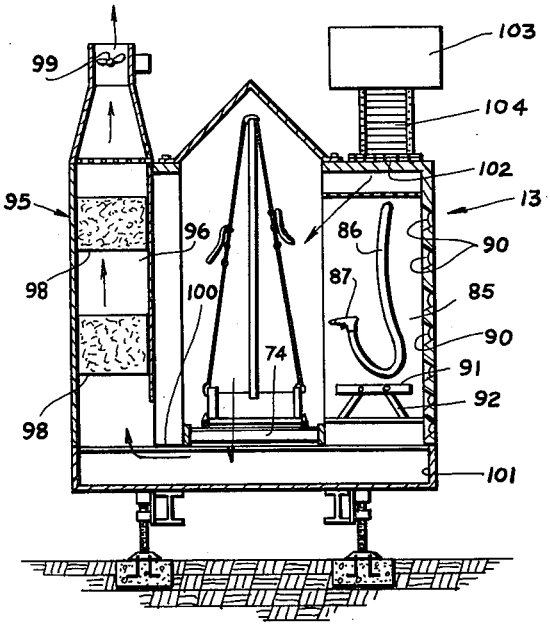
FIG. 6 is a side cross-sectional view of the coating section of the coating plant.

As illustrated in FIG. 6, the operators' stations each includes a plurality of high intensity lights 90 to illuminate the steel members as they move into the paint zone, and a vertically movable platform 91 elevates and lowers the operator so that the operator can see and apply a coating on the high and low surfaces of the steel members. The platform 91 is movable up and down by means of a motor-driven jack arrangement 92.

An air cleaning system 94 and 95 is located opposite to each operator's station 84 and 85. The air cleaning system includes a duct 96 that includes a plurality of dry filters 98, and a fan 99 is mounted in communication with the upper portion of the duct 96 to draw air in an upward direction through the duct. The duct 96 opens through a false floor 100 in the lower portion of coating section 13, and a pan 101 is located beneath the false floor 100. The openings between the rollers of roller conveyor 74 allow air to move downwardly between the rollers and then laterally across to the duct 96. An air opening 102 is defined above the operator's station, and a filter box 103 and heater 104 communicate with opening 102 to treat the air drawn into the coating section 13. Thus, the fan 99 tends to draw atmospheric air first through the filter box 103, then through the heater 104, then downwardly about the operator in the operator's station, then downwardly through the openings between the rollers in the roller conveyor 74, then across over the pan 101 to the duct 96, and then in an upward direction through the filters 98 in duct 96. Thus, the air is treated prior to being admitted to the coating section 13 and moves generally away from the face and body of the operator as the operator applies the spray paint to the steel members. The air, which becomes laden with paint from the spraying operation, then moves through the filters 98 prior to being exhausted to the atmosphere.

Figure 8:
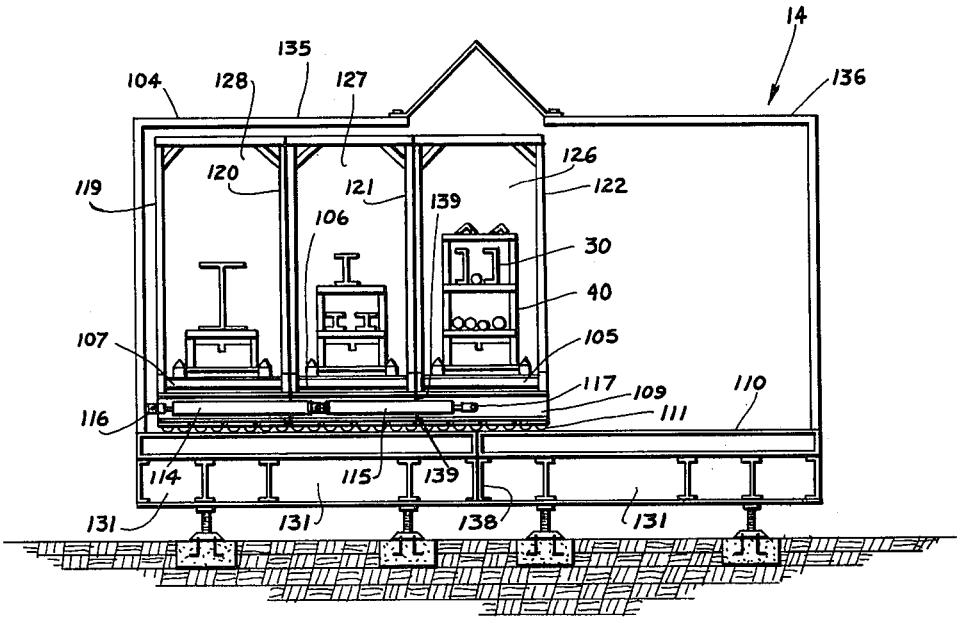
FIG. 8 is an end cross-sectional view of the drying section of the coating plant.
Figure 7:
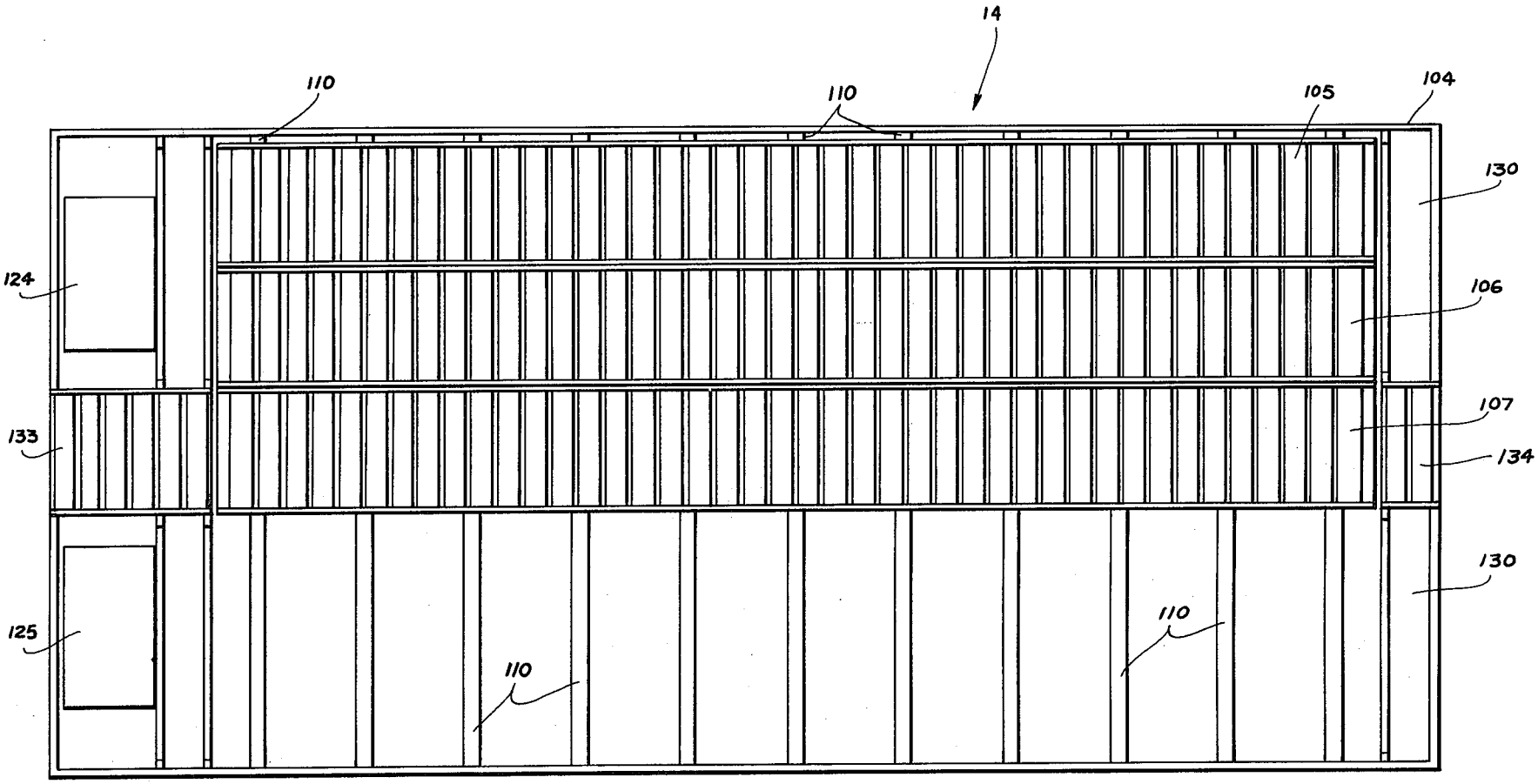
FIG. 7 is a plan view of the drying section of the coating plant.

As illustrated in FIGS. 7 and 8, the drying section 14 includes three individually operated roller conveyors 105, 106 and 107 positioned in the lower portion of housing 108, and the roller conveyors are all mounted on a transfer table 109. The transfer table is supported by a plurality of rollers 111 engaging support rails 110 in the lower frame of the dryer housing, and the support rails 110 extend across the length of the conveyors 105–107. The transfer table is thus movable across the drying section 14, and hydraulic rams 114 and 115 are connected in series with each other and at one end 116 by means of a clevis to the frame of the housing of the drying section 14 and at the other end 117 by means of a clevis to the transfer table 109. There may be two or more pairs of hydraulic rams 114 and 115 (only one pair shown), and when the transfer table 109 is moved all the way to the left (FIG. 8), both of the hydraulic rams 114 and 115 will be retracted. This positions the conveyor 105 in alignment with the conveyor of the coating section 13, so that conveyor 105 can receive the work cart 40 and structural members 30 from the coating section. In the meantime, the conveyors 106 and 107 will be out of alignment with the coating section conveyor. When one of the rams 114 or 115 is distended, the transfer table 109 will move across the drying section 14 a distance sufficient to place the middle conveyor 106 in alignment with the conveyor of the coating section, whereupon conveyors 105 and 107 will be on opposite sides of the conveyor path. When both of the rams 114 and 115 are distended, the left conveyor 107 will be positioned in alignment with the conveyor of the coating section 13.

Separation walls 119, 120, 121 and 122 divide the areas above the conveyors 105, 106 and 107 into separate chambers or tunnels 126, 127 and 128 and separate the environments above the conveyors 105, 106 and 107 from one another. Air blowers 124 and 125 are located at the entrance end of the housing 104 and heaters (not shown) function to heat the air exhausted from the blowers 124 and 125. The duct system from the blowers 124 and 125 functions to direct the air exhausted from the blowers into the chambers or tunnels 126, 127 and 128 above the conveyors 105, 106 and 107, so that the air moves along the length of the tunnels to the opposite end of the housing 104, whereupon the air moves in a downward direction through air ducts 130 (FIG. 7) into communication with the spaces 131 (FIG. 8) formed beneath the transfer table 109, whereupon the air moves back through the housing 104 to the inlet of the blowers 124 and 125. Thus, air is constantly recirculated to the chambers 126, 127 and 128.

The heating means (not shown) of the drying section 14 are thermostatically controlled and the duct work is proportioned so that the tunnel 126, 127 or 128 over a conveyor 105, 106 or 107 that happens to be in alignment with the conveyor of the coating section 13 receives high velocity air from the blowers 124, 125 while the other tunnels which are out of alignment with the coating section conveyor receive air at a lower velocity. Moreover, the heaters (not shown) function to heat the air directed to the tunnels out of alignment with the conveyor of the coating section so that the low velocity air is heated to a higher temperature.

Short sectional roller conveyors 133 and 134 are positioned at opposite ends of the drying section 14 in alignment with the conveyor of the coating section 13 to move the steel members into and out of the drying section.

When steel members are received in the drying section 14 from the coating section 13 on one of the conveyors 105, 106 or 107, the members and their work cart will be in a discrete tunnel which is separated from the tunnels above the other conveyors by the vertical wall separators 119–122, and high velocity air is directed through the tunnel for the purpose of "flashing off" or removing the solvents of the paint applied to the steel members. After a time lapse, the transfer table 109 will be moved by the actuation of one or both of the hydraulic rams 114 and 115 to shift the steel members laterally out of alignment with the conveyor line, to place another one of the conveyors 105, 106 or 107 in alignment with the coating section 13. This causes the steel members to be moved into a low velocity, high temperature area of the drying section 14, where the coatings applied to the members will be baked. Thus, the drying section functions as an evaporator and as a baking oven. The temperature of the high velocity air at the center of the housing 108 usually will be between 100° and 150° F., while the temperature of the lower velocity air at the sides of housing 108 usually will be between 200° and 400° F.

After the flashing off and baking of the steel members has been accomplished, the transfer table 109 is shifted to the position where it can discharge the members to the unloading section 15. The unloading section 15 is similar to the loading section 11 in that it includes a roller conveyor, a hoist and other apparatus necessary to retrieve the structural members from the work carts and place them on a trailer or other transporting means.

Housing 108 of drying section 14 is wider than the cleaning and coating sections 12 and 13 and is too wide to be moved over public highways. Housing 108 is formed in two sections 135 and 136 which are connected together at 138. The transfer table 116 is also formed in sections and parts at 139 so that conveyor 105 and rams 115 are moved with sections 136 and conveyors 106 and 107 and rams 114 are moved with section 137.

As shown in FIG. 1, a return conveyor 140 extends from the unloading section 15 to the loading section 11. The return conveyor 140 is formed in sections placed in end-to-end relationship with respect to one another, and the sections can be a combination of gravity feed roller sections and power driven roller sections, with the purpose of the return conveyor 140 being to return the work carts of the unloading section to the loading section.

While the portable automated coating plant 10 has been disclosed as including the loading section 11, cleaning section 12, coating section 13, drying section 14 and unloading section 15, it should be understood that the sections can be used individually or with less than all of the other sections. For example, the cleaning section 12 can be used individually by using other loading apparatus and without using a coating or drying system, or the cleaning section can be used only with the loading and unloading sections. Other combinations of the sections can be used as may suit particular needs.

It will be understood that a particular embodiment of the invention is shown by way of illustration only, and other embodiments of the same invention are equally encompassed, as described in the accompanying claims.

We claim:

1. A continuous method of treating a series of metal members comprising progressively moving the members along a rectilinear path on a continuous surface conveyor through a series of juxtaposed enclosed work sections substantially without exposure to the environment outside said work stations, and as the members move separately along the rectilinear path, progressively heating the members as the members are moved along the path into a cleaning section toward a shot blast machine, progressively cleaning the members with shot as the members are moved along the path through the cleaning section while the members are hot from the previous step of heating the members, coating the members when the members have moved along the path from the cleaning section into a coating section, and drying the coating when the members have moved out of the coating section into a drying section by first circulating air at a first temperature about the members while the members are still in the rectilinear path and then moving the members laterally out of the path and circulating air at a second temperature higher than the first temperature about the members.

2. The method of claim 1 and wherein the step of moving the members along a rectilinear path comprises intermittently moving the members along a rectilinear path.

3. The method of claim 1 and further including the step of removing loose shot and other loose matter from the members after the step of cleaning the members with shot and before the step of coating the members.

4. The method of claim 1 and wherein the step of coating the members comprises spraying liquid paint on the surfaces of the members from spray nozzles positioned on opposite sides of the path of movement of the members and offset from each other along the path of movement of the members, moving air from the atmosphere about the members as the members are sprayed, exhausting the air from about the members away from the spray nozzles to the atmosphere, and removing paint from the air as the air is exhausted from about the members to the atmosphere.

5. The method of claim 1 wherein the step of moving the members along a path comprises placing carts on a surface conveyor, mounting the members on the carts and moving the members and carts along the surface conveyor.

6. The method of claim 1 and wherein the step of cleaning the members includes the step of directing a flow of air at the members.

* * * * *

UNITED STATES PATENT OFFICE

CERTIFICATE OF CORRECTION

Patent No. 4,096,300 Dated June 20, 1978

Inventor(s) Virgil R. Williams and James M. Williams, Jr.

It is certified that error appears in the above-identified patent and that said Letters Patent are hereby corrected as shown below:

Change the spelling of the first listed inventor's last name from "William" to -- Williams--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*